US007328546B2

(12) United States Patent
Martelli

(10) Patent No.: US 7,328,546 B2
(45) Date of Patent: Feb. 12, 2008

(54) DEVICE FOR CLOSING BOXES AND THE LIKE

(75) Inventor: Antonio Martelli, Arzachena (IT)

(73) Assignee: O.A.M. - Societa' per Azioni, Pianoro (IT)

( * ) Notice: Subject to any disclaimer, the term of this patent is extended or adjusted under 35 U.S.C. 154(b) by 0 days.

(21) Appl. No.: 11/709,088

(22) Filed: Feb. 22, 2007

(65) Prior Publication Data

US 2008/0000197 A1 Jan. 3, 2008

(30) Foreign Application Priority Data

Jun. 30, 2006 (IT) ..... BO2006A0501

(51) Int. Cl.
*B65B 51/00* (2006.01)

(52) U.S. Cl. ..... 53/377.5

(58) Field of Classification Search ..... 53/377.5
See application file for complete search history.

(56) References Cited

U.S. PATENT DOCUMENTS 2,625,778 A * 1/1953 Wood ..... 53/377.2
2,669,167 A * 2/1954 Behl ..... 493/168
2,948,094 A * 8/1960 Wells ..... 53/467
3,421,288 A * 1/1969 Kund et al. ..... 53/377.3
4,035,989 A * 7/1977 Schuster ..... 53/566
4,805,375 A * 2/1989 Langen et al. ..... 53/142
5,595,043 A * 1/1997 Radigan ..... 53/201
5,863,380 A * 1/1999 Gambetti ..... 156/443
6,941,725 B2 * 9/2005 Gaudenzi ..... 53/377.5

* cited by examiner

*Primary Examiner*—John Sipos
(74) *Attorney, Agent, or Firm*—Modiano & Assocati; Albert Josif; Daniel J. O'Byrne

(57) ABSTRACT

A device for closing boxes which are each provided, at least one end face, with at least one flap with a complementary end flap and with at least two folding lateral tabs which mutually interlock in the closure configuration with the complementary end flap, comprising, arranged laterally with respect to the direction of advancement of the boxes and one after the other, a folding element for folding the flap with respect to the box, at least one first rotating element for folding the complementary flap with respect to the flap, at least one second rotating element for inserting the complementary flap in the mouth of the box, and at least one third rotating element for interlocking the complementary flap with the lateral tabs, to completely close the box.

18 Claims, 5 Drawing Sheets

DEVICE FOR CLOSING BOXES AND THE LIKE

The present invention relates to a device for closing boxes and the like.

BACKGROUND OF THE INVENTION

Boxes for packaging products of various kinds are commercially widespread which are traditionally constituted by parallelepipeds made of a material such as cardboard and are provided, at the two end faces, with closure flaps and tabs which mutually interlock.

Automatic machines which insert products in such boxes currently comprise at least one station where the flaps and tabs are closed after the product to be packaged has been inserted in the box.

These stations usually comprise closure elements which are operated by crank systems arranged at the two sides of the advancement line of said boxes; the motion of said crank systems defines a path which is suitable to guide the flaps, which are open and extended, in the direction for closure, making them interlock with the tabs provided at the end faces.

Currently, the use of these closure elements is rather disadvantageous for two main reasons.

First of all, such elements comprise oscillating masses whose high inertia limits the speed at which they can be operated, mainly due to problems linked to the transmission of vibrations which can become intolerable: this evidently makes it impossible to achieve the ever-increasing production rates currently required by the market.

Secondly, said closure elements comprise parts which are specifically intended for direct contact with the product and are sized according to the format of each box that the machine can fill: these parts must of course be adjusted whenever the dimensions of the box change. This need forces to stop production for periods of time currently considered too long in order to perform the adjustments.

SUMMARY OF THE INVENTION

The aim of the present invention is to obviate the above-mentioned drawbacks, by providing a device for closing boxes and the like which allows to increase significantly the packaging speeds with respect to those obtainable with the mechanisms currently being used.

Within this aim, an object of the present invention is to provide a device for closing boxes which is of universal use and is provided with elements and mechanical parts which can be replaced rapidly and are already adjusted in the correct operating positions, so as to minimize format changing time.

Another object of the present invention is to provide a device for closing boxes which allows a quick and reliable configuration which persists during operation until the next format change.

Another object of the present invention is to provide a device which is simple, relatively easy to provide in practice, safe in use, effective in operation, and has a relatively low cost.

This aim and these and other objects which will become better apparent hereinafter are achieved by a device for closing boxes and the like, of the type suitable to close boxes which are each provided, at least one end face, with at least one flap with a complementary end flap and with at least two folding lateral tabs which mutually interlock in the closure configuration with the complementary end flap, characterized in that it comprises, arranged laterally with respect to the direction of advancement of said boxes and one after the other, means for folding said flap with respect to the box, at least one first rotating element for folding the complementary flap with respect to the flap, at least one second rotating element for inserting the complementary flap in the mouth of the box, and at least one third rotating element which is suitable to interlock the complementary flap with the tabs, thus providing complete closure of the box.

BRIEF DESCRIPTION OF THE DRAWINGS

Further characteristics and advantages of the invention will become better apparent from the following detailed description of a preferred but not exclusive embodiment of a device for closing boxes and the like according to the invention, illustrated by way of non-limiting example in the accompanying drawings, wherein.

DESCRIPTION OF THE PREFERRED EMBODIMENTS

In the exemplary embodiment that follows, individual characteristics may actually be interchanged with other different characteristics that exist in other exemplary embodiments.

Moreover, it is noted that anything found to be already known during the patenting process is understood not to be claimed and to be the subject of a disclaimer.

Figure 1:
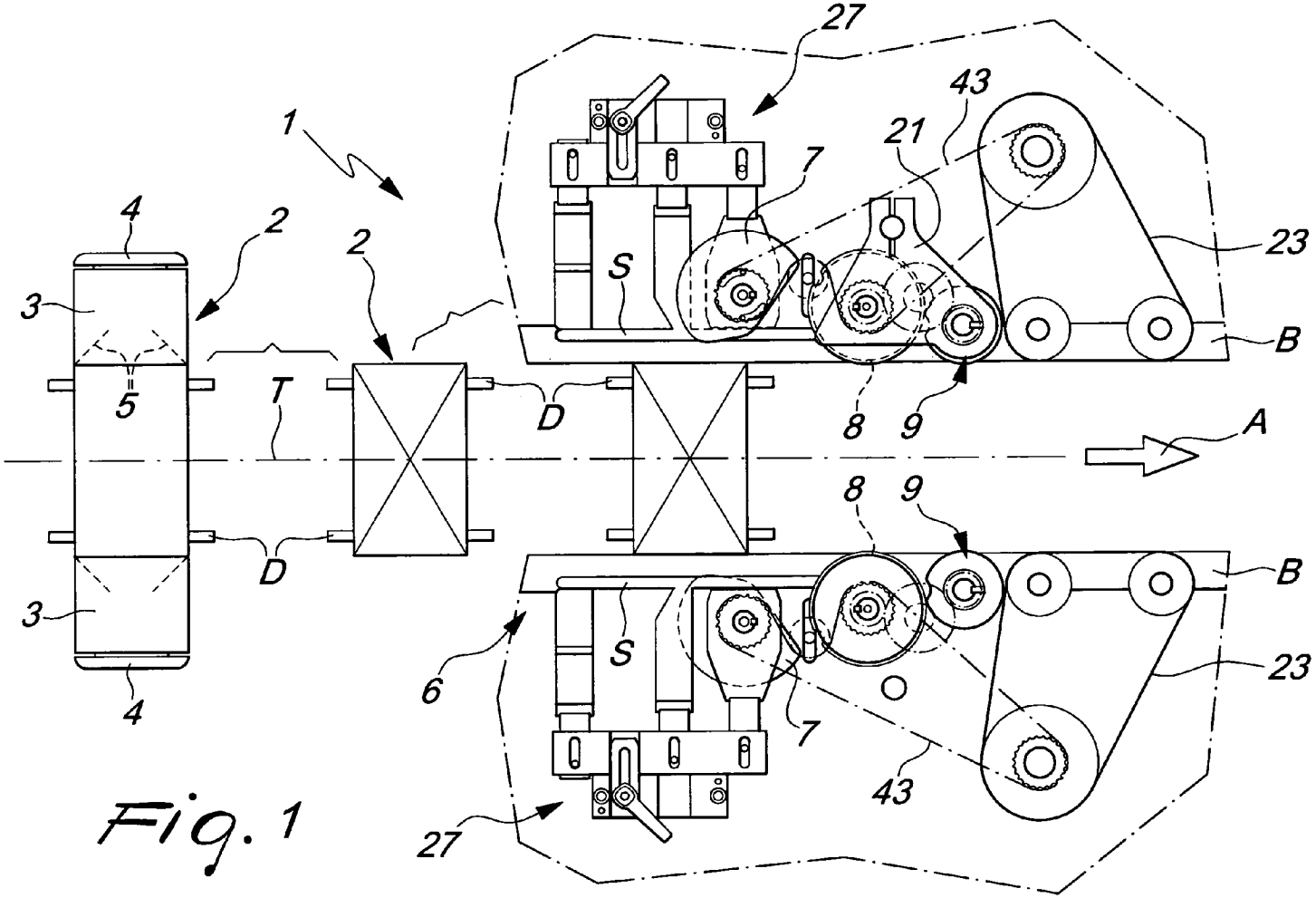
FIG. 1 is a schematic plan view of the device according to the invention.
Figure 2:
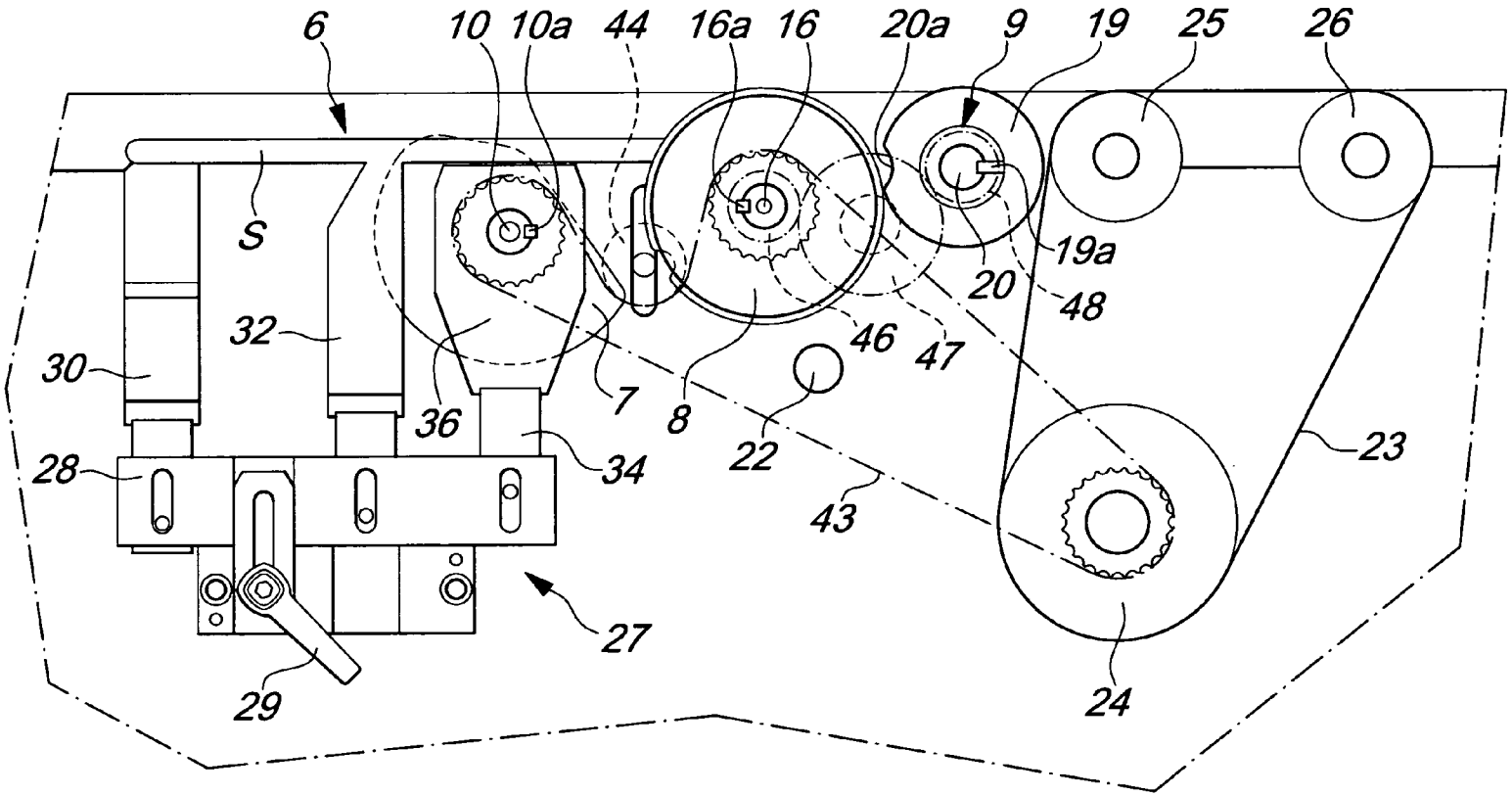
FIG. 2 is a view of a first detail of FIG. 1.

With reference to FIG. 1, the reference numeral 1 generally designates a device for closing boxes and the like, according to the invention.

The device allows to effectively close boxes, each generally designated by the reference numeral 2, which are substantially shaped like a parallelepiped and have at least one mouth at which there is a folding flap 3, a complementary end flap 4 which protrudes from the flap 3, and two folding lateral tabs 5, which are adapted to interlock, in the closed configuration, in lateral notches formed along the folding line between said flap and said complementary flap.

The device described hereinafter, as will become better apparent, closes boxes of any size without having to perform adjustments of parts but by replacing preadjusted parts, without therefore having to stop the production system for long periods.

The device is supported by a footing B of a substantially traditional type and is associated with a line T for conveying the boxes 2 in succession, said line preferably but not exclusively comprising a plurality of receptacles with teeth D which retain each box 2 open in a substantially parallelepipedal configuration.

The boxes 2 therefore arrive from other preceding production stations where they have been unfolded and are provided with the lateral tabs 5 folded toward the mouth.

The device according to the invention advantageously comprises, arranged laterally with respect to the advancement direction A of the boxes 2 and in succession one after the other, folding means 6 for folding the flap 3 with respect to the box 2, at least one first rotating element 7 for folding the complementary end flap 4 with respect to the flap 3, at least one second rotating element 8 for insertion of the complementary end flap 4 in the mouth of the box 2, and at least one third rotating element 9, which is suitable to interlock the complementary flap 4 with the tabs 5, thus providing complete closure of the box 2.

More particularly, the device is adapted to close the boxes 2 each of which is provided, at two mutually opposite end faces, with the respective flaps 3 with the complementary end flaps 4 and two respective lateral tabs 5 which can fold and mutually interlock in the closure configuration with said complementary end flaps. The device can close boxes 2 which have so-called "even" or "alternated" flaps 3, i.e., flaps which protrude respectively from a same side of the parallelepiped or from mutually opposite sides. Therefore, in the case of boxes 2 with two mouths as is indeed most frequently the case, the device according to the invention conveniently comprises, arranged on each of the two sides which are mutually opposite with respect to the advancement direction A of said boxes and in succession one after the other, the means 6 for folding each flap 3 with respect to the box 2, at least one first rotating element 7 for folding each complementary flap 4 with respect to the flap 3, at least one second rotating element 8 for the insertion of each complementary flap 4 in the respective mouth of the box 2, and at least one third rotating element 9, which is suitable to interlock each complementary flap 4 with the respective tabs 5.

The folding means 6 preferably but not exclusively comprise, for each of the sides, at least one shaped bar S (which is for example bent back with an appropriate inclination), which is substantially parallel to the advancement direction A of the boxes 2 and forms conveniently a profile which is suitable to apply, due to the advancement motion of said boxes, an appropriate pressure against the flap 3 of each box 2.

The first rotating element 7 is keyed along a respective first shaft 10 by means of a first key 10*a*; the first shaft 10 is supported so that it can rotate, with a substantially vertical axis, in the footing B of the device laterally to the advancement direction A of the boxes 2 and is associated with respective actuation means, generally designated by the reference numeral 11.

The coupling of the first rotating element 7 with the first shaft 10, provided by means of the first key 10*a*, allows to define a specific angular working phase of said first element in relation to a specific format of the box 2 to be closed: said phase must be achieved only once during the tuning of the machine and is maintained whenever a format change is performed, i.e., when the first rotating element 7 is changed in relation to the dimensions of the box 2. This obviously allows to minimize the tuning and adjustment times of the machine. In greater detail, the first rotating element 7 is associated with a respective disk 11*b* (which is keyed to the first shaft 10 by means of the key 10*a*) by way of two slots 12*a*, 12*b*, which allow to adapt the phase of the first rotating element 7 to the different characteristics of the boxes to be closed, so as to ensure correct folding of the complementary flap 4 with respect to the flap 3.

Advantageously, the first rotating element 7 has a substantially circular shape, with a perimetric edge 13 which forms at least two substantially straight portions 14 and 15 which have an appropriate inclination and are suitable to engage, in the rotation of the first rotating element 7 (concordantly with the advancement of the boxes) on the complementary flap 4, folding it at right angles with respect to the flap 3. The first rotating element 7 conveniently has a vertical position which can be adjusted along the first shaft 10 in relation to the dimensions of the box 2 and also in relation to the shape of the box 2, i.e., to the position of the flap 3 with respect to said box.

Figure 5:
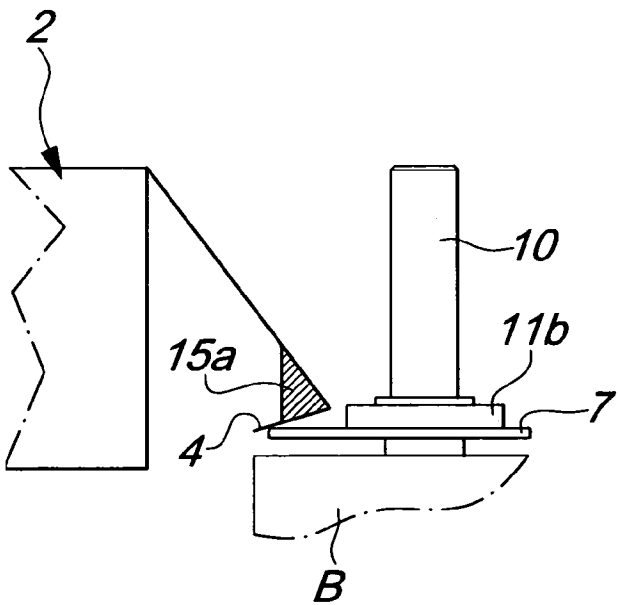
FIG. 5 is a partially sectional schematic rear view of the first rotating element.

The first rotating element 7 is associated with a contrast element 15*a* which has a substantially triangular transverse cross-section and allows to fold correctly the complementary flap 4 with respect to the flap of each box, as can be deduced intuitively from FIG. 5.

The second rotating element 8 is keyed rigidly along a respective second shaft 16 by means of a second key 16*a*, the second shaft 16 being supported so that it can rotate, with a substantially vertical axis, in the footing B of the device, laterally to the advancement direction A of the boxes, and being associated with the actuation means 11.

The second rotating element 8 has a substantially cylindrical contoured shape, in which the lateral surface forms planes 17 which are suitably inclined with respect to the axis of said element, said inclination being studied in relation to the relative motion between the device and each box, suitable to engage, as a consequence of the rotation which is concordant with the advancement of the boxes, against the flap 3, providing such a pressure as to insert the complementary flap 4 in the mouth of the box 2. The second rotating element 8 of course can have a lateral surface which forms several planes 17, each having respective areas and inclinations with respect to the axis, or even one or more sectors having a reduced diameter in relation to the specific requirements and the geometries of the boxes, so as to determine a sort of cam-like contact which, by rotation, guides the flap 3, inserting the complementary flap 4 in the mouth.

Figure 6:
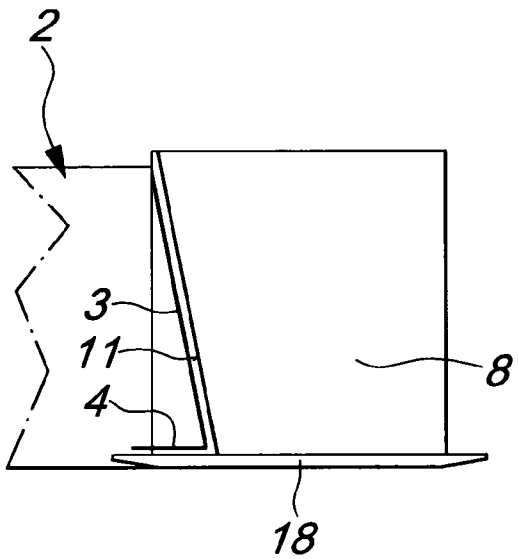
FIG. 6 is a partially sectional schematic rear view of the second rotating element.

The second rotating element 8 is associated advantageously, on one of the faces, with at least one circular plate 18 (see in particular FIG. 6), which is suitable to be inserted partially in the mouth of the box 2 so as to keep it sufficiently divaricated to ensure correct insertion of the complementary flap 4 inside it, without sliding which might compromise the correct closure of the boxes. The plate 18 is affected by at least one recess 18*a* which, adjusted with the appropriate phase with respect to the advancement motion of the boxes, allows to avoid interference with the side wall of the box 2.

The second rotating element 8 can be fixed adjustably with respect to the second shaft 16 by means of slots so as to adapt the phase of said element in relation to the mechanical and dimensional characteristics of the boxes.

Figure 7:
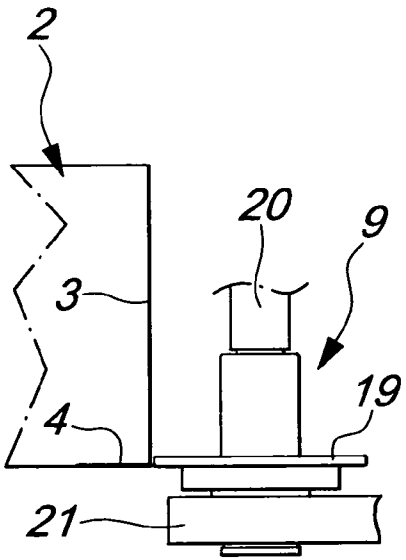
FIG. 7 is a partially sectional schematic rear view of the third rotating element.

The third rotating element 9 (shown in FIG. 7) comprises a disk 19 which is rigidly keyed, by means of a third key 19*a*, on a third shaft 20, which is supported so that it can rotate in the footing B and is controlled by the actuation means 11. The disk 19 is conveniently adapted, in its rotation concordantly with the advancement of the boxes 2, to apply an appropriate pressure to the flap 3 of each box so as to provide the interlocking of the complementary flap 4 with the lateral tabs 5 and achieve complete closure of said box. The disk 19 is affected by a recess 20*a* which, adjusted in appropriate phase with respect to the advancement motion of the boxes, allows to avoid interference with the side wall of the box 2.

Figure 3:
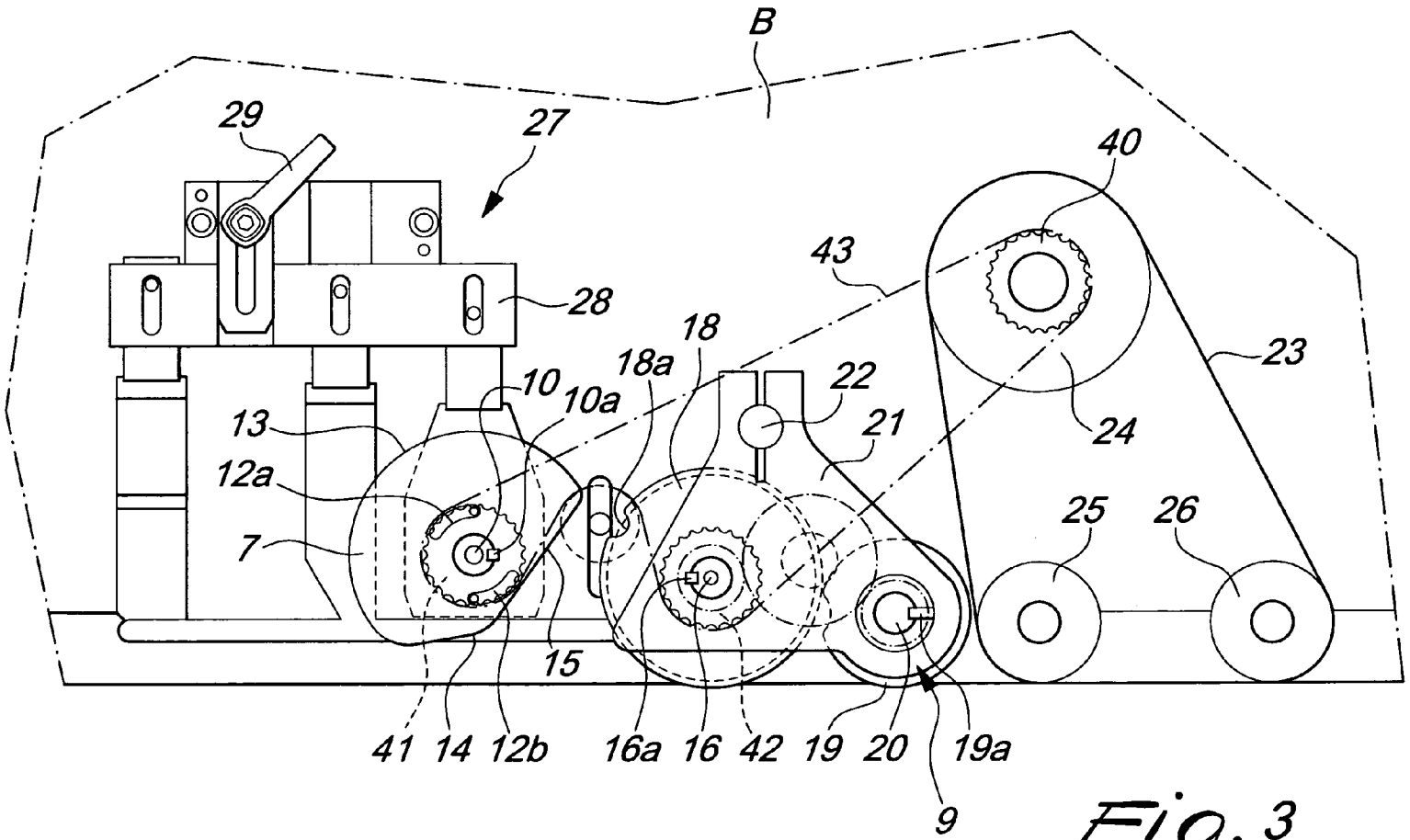
FIG. 3 is a view of a second detail of FIG. 1.
Figure 4:
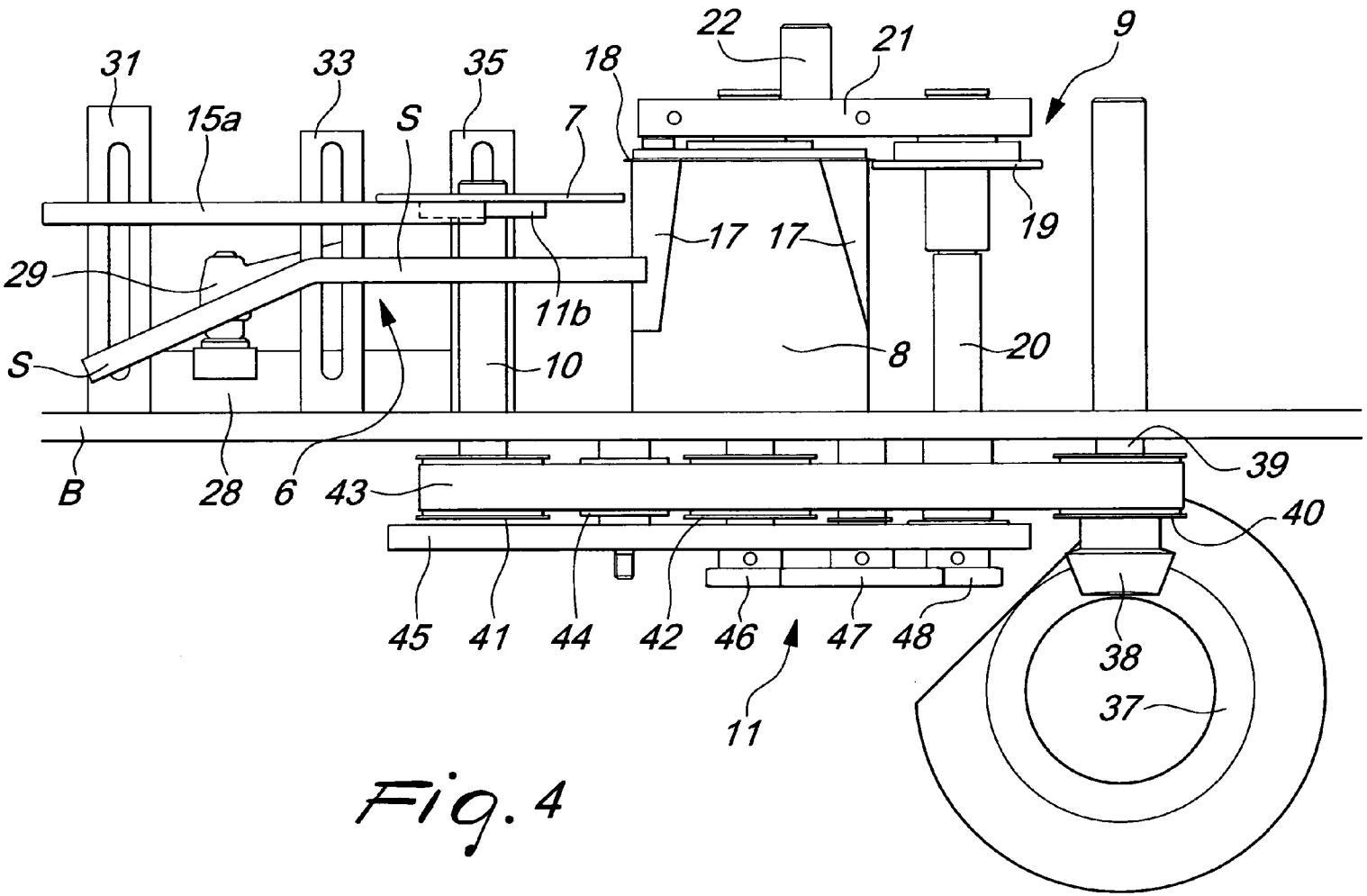
FIG. 4 is a side elevation view of the detail of FIG. 3.

The embodiment described here relates in particular to the closure of boxes with so-called "alternating" flaps; for this purpose, the first rotating element 7, the second rotating element 8 and the third rotating element 9 are arranged, on one side (the right side with respect to the advancement direction), very close to the surface of the footing B, and on the other side (right side with respect to the advancement direction of the boxes) are positioned at an appropriate height in relation to the dimensions of the box. The second rotating element 8 and the third rotating element 9 are, along this last side, mounted on a plate-like support 21 with bearings (FIG. 3), said support being mounted at an adjustable height by means of a clamp on a rod 22 which is rigidly coupled to the footing B.

Further, on each of the sides with respect to the advancement direction of the boxes there is at least one belt 23, which is wound around at least one driving roller 24 and two driven rollers 25, 26, which are supported so that they can rotate with a substantially vertical axis in the footing B; each of the belts 23 is suitable to extract the closed boxes 2 from the respective toothed receptacles D in order to then convey them to the outlet of the box packaging machine.

Conveniently, the folding means 6 and the first rotating element 7 are associated, for each of their sides, with removable supporting means 27, which allow to replace rapidly and monolithically the parts for each of the formats being produced without having to perform adjustments and fine tuning.

In greater detail, the supporting means 27 comprise a longitudinal member 28, which is parallel to the advancement direction of the boxes 2 and is fixed adjustably to the footing B in a slot by means of a lever 29 with quick opening and closing; a first arm 30, a second arm 32 and a third arm 34 are fixed adjustably by means of slots to the longitudinal member 28; a first slotted column 31 for vertical adjustable support of the contrast element 15*a* is rigidly coupled to the first arm 30; a second slotted column 33 for vertical adjustable support of the contoured bar S is rigidly coupled to the second arm 32; a third slotted column 35 is rigidly coupled to the third arm 34. The third slotted column 35 supports, so that it can be adjusted vertically, a plate 36 with which the first element 7 is advantageously associated so that it can rotate.

As is intuitive, therefore, by removing the entire supporting means 27, the contoured bar A, the contrast element 15*a* and the first rotating element 7 are removed monolithically; this allows to pass rapidly from one format to another in a short time and without further adjustments, since said parts have been fine-tuned beforehand in the correct positions and phases. Likewise, the second rotating element 8 and the third rotating element 9 also can be removed rapidly (slid off their supporting shafts) and replaced with the ones related to the specific format being produced. The actuation means 11 comprise at least one pair of bevel gears 37, 38, which mesh together and are adapted to transmit motion from at least one motor, for example an electric motor (supported in the footing B and not shown for the sake of simplicity in the figures, but of a substantially traditional type), to a motor shaft 39, on which the driving roller 24 is mounted.

A first toothed pulley 40 is rigidly keyed on the motor shaft 39, while on the first shaft 10 and on the second shaft 16 a second toothed pulley 41 and a third toothed pulley 42 are rigidly coupled respectively; the first pulley 40, the second pulley 41 and the third pulley 42 mesh with a toothed belt 43, which is adjusted by means of a tensioning roller 44 which is fixed adjustably to the footing.

A lower plate 45, which is fixed below the surface of the footing B, rotatably supports a first gear 46, a second gear 47 and a third gear 48, which constitute a gear system which transmits motion from the second rotating element 8 to the third rotating element 9. The first toothed gear 46 is in fact rigidly keyed along the second shaft 16, while the third toothed gear 48 is rigidly keyed along the third shaft 20; the second gear 47 is instead idle.

The operation of the device according to the invention is as follows.

Each box 2 advances along the direction A and encounters first the folding means 6, which by passive contrast of the contoured bar 6*a* fold the flap 3 with respect to the side of the box 2. The rotation of the first rotating element 7 subsequently determines, by way of the contact of its portions 14, against the complementary flap 4 and in cooperation with the contrast element 15*a*, the folding of said contrast element with respect to the flap 3. The rotation of the second element 8, in association with the plate 18, subsequently allows insertion of the complementary flap 4 in the mouth of the box; finally, the third rotating element 9 provides the permanent interlocking of the complementary flap 4 with the lateral tabs 5, closing the box 2. This sequence of operations occurs of course simultaneously for both sides of the device, i.e., for both mouths of the boxes 2.

It has thus been shown that the invention achieves the intended aim and objects.

The device allows to close boxes of any size without having to perform mechanical adjustments but merely by performing quick and simple replacements of parts which are already preadjusted in their positions and rotation phases.

Further, the device allows to increase significantly the speed of the production line, since there are no large oscillating masses, which are typically characterized by vibration problems.

The invention thus conceived is susceptible of numerous modifications and variations, all of which are within the scope of the appended claims.

Further, all the details may be replaced with other technically equivalent ones.

In practice, the materials used, as well as the shapes and dimensions, may be any according to requirements without thereby abandoning the scope of the protection of the appended claims.

The disclosures in Italian Patent Application No. BO2006A000501 from which this application claims priority are incorporated herein by reference.

What is claimed is:

1. A device for closing boxes, each of which provided, at at least one end face thereof, with at least one flap, with a complementary end flap and with at least two folding lateral tabs which mutually interlock in a closure configuration of the box, with the complementary end flap, the device being suitable to be arranged along a conveying line for conveying the boxes along a direction of advancement and comprising: folding means for folding said at least one flap with respect to the box, at least one first rotating element for folding the complementary flap with respect to the at least one flap; at least one second rotating element for inserting the complementary flap in a mouth of the box, and at least one third rotating element for interlocking the complementary flap with the lateral tabs, whereby to complete closure of the box, said first, second and third rotating elements and said folding means being arranged laterally with respect to the direction of advancement of the boxes and one after the other.

2. A device for closing boxes, each of which provided, at two end faces thereof, with respective flaps with complementary end flaps and two respective folding lateral tabs which mutually interlock in the closure configuration with the complementary end flaps, the device being suitable to be arranged along a conveying line for conveying the boxes along a direction of advancement and comprising: folding means for folding each flap with respect to the box; at least one first rotating element for folding each complementary flap with respect to the flap; at least one second rotating element for insertion of each complementary flap in a respective mouth of the box; and at least one third rotating element, which is for providing interlocking of each complementary flap with the respective lateral tabs, whereby to provide complete closure of the box, said folding means and said first, second and third rotating elements being arranged on each one of two sides which are mutually opposite with respect to the advancement direction of the boxes and in succession one after the other.

3. The device of claim 1, comprising: a first shaft, which is supported so as to be rotatable about a substantially vertical axis thereof in a footing of the device laterally with respect to the advancement direction of the boxes; a first key, said first rotating element being rigidly keyed by way of said first key along said first shaft; and respective actuation means connected to said first rotating element for actuation thereof.

4. The device of claim 3, comprising: a respective second shaft, which is supported so as to be rotatable about a substantially vertical axis thereof, in a footing of the device laterally to the advancement direction of the boxes; and a second key, said second rotating element being rigidly keyed, by way of said second key, along said second shaft; and respective actuation means connected to said second rotating element for actuation thereof.

5. The device of claim 3, wherein said first rotating element has a substantially circular shape, with a perimetric edge which forms at least one substantially straight portion that has an inclination such as to be suitable to engage, during rotation of said first element, on the complementary flap to fold it with respect to the at least one flap.

6. The device of claim 5, wherein said first rotating element is provided with at least one contrast element that is associated thereto and which has a substantially triangular transverse cross-section so as to allow correct folding of the complementary flap with respect to the at least one flap of each box.

7. The device of claim 3, further comprising: a respective disk, associated with said first rotating element, and which is keyed to said first shaft by way of said first key through two slots of the first rotating element and which allow to adapt a phase of said first rotating element to different characteristics of the boxes to be closed, so as to ensure a correct folding of the complementary flap with respect to the at least one flap.

8. The device of claim 4, wherein said second rotating element has a substantially cylindrical contoured shape, with a lateral surface thereof forming at least one plane which has an inclination such as to be suitable to engage, during rotation of said second rotating element, against the at least one flap, providing the insertion of the complementary flap in the mouth of the box.

9. The device of claim 8, comprising at least one circular plate, which is suitable to enter partially the mouth of the box, so as to keep the mouth in position and divaricated in order to ensure correct insertion of the complementary flap thereinside, said second rotating element being associated, on at least one of its faces, with said at least one circular plate.

10. The device of claim 9, wherein said plate comprises at least one recess which is suitable to be arranged in correct phase with respect to the advancement motion of the boxes, so as to avoid interference with a side wall of the box.

11. The device of claim 4, further comprising: a third key and a third shaft which is supported so as to be rotatable in the footing of the device and is controlled by said actuation means, said third rotating element comprising at least one disk which is rigidly keyed, by way of said third key, on said third shaft, said disk being suitable, during rotation thereof concordantly with an advancement of the boxes, to apply an appropriate pressure to the at least one flap of each box, so as to provide interlocking of the complementary flap with the lateral tabs.

12. The device of claim 11, wherein said disk comprises a recess which is adjustable in a correct phase with respect to an advancement motion of the boxes so as to avoid interference with a side wall of the box.

13. The device of claim 12, wherein said boxes are conveyed retained each in a respective receptacle with teeth, the device further comprising at least one driving roller; two driven rollers which are supported so as to be rotatable about a substantially vertical axis thereof in the footing of the device, at least one belt provided for each of the sides with respect to the advancement direction of the boxes, and which is wound around said at least one driving roller and two driven rollers, said belts being suitable to extract closed boxes from the respective receptacles with teeth to then convey the boxes toward an outlet of a filling machine.

14. The device of claim 6, comprising manually detachable supporting means, provided for each of two opposite sides with respect to the advancement direction of the boxes, and with which said folding means, said first rotating element and said contrast element are associated, said detachable supporting means being suitable to allow rapid replacement of mechanical parts of the device which are providable in a variable form according to a format of the box being closed.

15. The device of claim 14, wherein said detachable supporting means comprise: at least one longitudinal member, which is parallel to the advancement direction of the boxes and is fixed adjustably to the footing of the device; a first arm; a second arm; a third arm being fixed adjustably by way of slots thereof to said longitudinal member; a first slotted column for a vertical adjustable support of said contrast element that is rigidly coupled to said first arm; a second slotted column for vertical adjustable support of said folding means that is rigidly coupled to said second arm; a third slotted column that is rigidly coupled to said third arm and that is supported and vertically adjustable on said third arm, said first rotating element being associated with said plate.

16. The device of claim 4, wherein said actuation means comprise: at least one motor supported in the footing of the device; a motor shaft; at least one pair of bevel gears, which mesh together and are suitable to transmit motion from said at least one motor to the motor shaft; a first toothed pulley being rigidly keyed to said motor shaft; a second toothed pulley; a third toothed pulley that is rigidly keyed respectively on said first shaft and on said second shaft; and a toothed belt which is provided adjustable by way of a tensioning roller which is fixed adjustably in said footing of the device, said first pulley, said second pulley and said third pulley meshing with said toothed belt.

17. The device of claim 16, wherein said actuation means further comprise: at least one lower plate, which is fixed below the surface of the footing of the device; a first gear, a second gear and a third gear, which constitute a gear system which is suitable to transmit motion from said second rotating element to said third rotating element and is supported rotatable on said plate, said first gear being rigidly keyed along said second shaft, said third gear being rigidly keyed along said third shaft and said second gear being an idle gear.

18. The device of claim 1, wherein said folding means comprises at least one contoured bar, which is arranged substantially parallel to the advancement direction of the boxes and has a shape suitable to determine engagement thereof against the at least one flap of each box during advancement thereof.

* * * * *